United States Patent [19]

Hansen et al.

[11] Patent Number: 4,660,386

[45] Date of Patent: Apr. 28, 1987

[54] DIAGNOSTIC SYSTEM FOR DETECTING FAULTY SENSORS IN LIQUID CHILLER AIR CONDITIONING SYSTEM

[76] Inventors: John C. Hansen, R.D. 1 Stauffer Rd., Spring Grove, Pa. 17362; Harold B. Ginder, 835 Clare La., York, Pa. 17402; Lloyd A. Johnson, P.O. Box 159, Liverpool, N.Y. 13088

[21] Appl. No.: 777,383

[22] Filed: Sep. 18, 1985

[51] Int. Cl.[4] ..... F25B 49/00

[52] U.S. Cl. ..... 62/126; 62/158; 62/201; 364/185

[58] Field of Search ..... 62/126, 127, 201, 158; 364/551, 557, 558, 185, 187

[56] References Cited

U.S. PATENT DOCUMENTS

| | | | |
|---|---|---|---|
| 4,122,720 | 10/1978 | Podl | 364/511 X |
| 4,249,238 | 2/1981 | Spang, III et al. | 60/39.24 X |
| 4,282,719 | 8/1981 | Kountz et al. | 62/115 |
| 4,325,223 | 4/1982 | Cantley | 62/126 |
| 4,337,516 | 6/1982 | Murphy et al. | 364/551 |
| 4,381,549 | 4/1983 | Stamp et al. | 364/557 |
| 4,432,210 | 2/1984 | Saito | 62/126 |
| 4,535,598 | 8/1985 | Mount | 62/201 X |

*Primary Examiner*—Harry Tanner

[57] ABSTRACT

When sensors are employed to monitor the evaporator refrigerant pressure and the leaving chilled liquid temperature in an air conditioning system of the type having a liquid chiller, the sensor outputs will normally have a prescribed relationship with respect to each other as long as the sensors are functioning properly and regardless of the operating condition of the air conditioning system. By effectively comparing the output of one sensor relative to that of the other sensor, a faulty condition of either sensor may be detected. This is achieved by calculating the equivalent evaporator temperature, from the evaporator refrigerant pressure, and subtracting the equivalent temperature from the leaving chilled liquid temperature to obtain a difference temperature which is then compared to a predetermined known temperature range representing normal functioning of the two sensors. When one of the sensors is defective the difference temperature will fall outside of the range. If that occurs, a warning message that a faulty sensor has been detected is displayed to operating personnel and the air conditioning system's compressor is shut down as a safety precaution.

10 Claims, 4 Drawing Figures

DIAGNOSTIC SYSTEM FOR DETECTING FAULTY SENSORS IN LIQUID CHILLER AIR CONDITIONING SYSTEM

BACKGROUND OF THE INVENTION

This invention relates to a diagnostic system for effectively testing the operation of sensors which sense the evaporator refrigerant pressure and the leaving chilled liquid temperature in a liquid chiller air conditioning system and for providing a warning when at least one of the sensors is found to be defective.

Large commercial and industrial air conditioning systems typically employ centrifugal liquid chillers. As the refrigerant flows through the system's evaporator, circulating liquid (usually water), which is in heat exchange relationship with the refrigerant, transfers heat to the refrigerant. The chilled liquid leaving the evaporator is then delivered to remote locations and used to cool a building or a zone. By maintaining the temperature of the leaving chilled liquid at a desired setpoint, the cooled space may be held at a desired temperature. The required control is usually accomplished by sensing the leaving chilled liquid temperature and adjusting the position of the guide vanes or prerotation vanes, at the inlet of the system's centrifugal compressor, in response to the sensed temperature. Adjusting the prerotation vanes varies the capacity of the centrifugal compressor, which in turn changes the refrigeration capacity of the system.

In addition to the sensor for sensing the leaving chilled liquid temperature, for safety reasons a sensor is usually provided to monitor the pressure of the refrigerant in the evaporator. If the evaporator pressure or the leaving chilled liquid temperature is too low, the chiller liquid passing over the evaporator tubes could freeze and cause damage to the air conditioning unit. Thus, by monitoring both the evaporator refrigerant pressure and the leaving liquid temperature, when either one of those variables drops below a minimum allowable level the unit may be shut down to prevent freezing of the circulating chilled liquid.

Of course, proper operation of the monitoring system requires valid information from the evaporator pressure sensor and from the leaving liquid temperature sensor. Unfortunately, in the past there was no way to check the individual sensors to verify or confirm that they were functioning properly. The failure of a sensor could go undetected and cause undesirable system operation or freeze-up without generating a system fault. If a sensor malfunctions there is no way of discovering this in the prior air conditioning systems.

This shortcoming has now been overcome by the present invention. By means of a relatively inexpensive arrangement, faulty evaporator pressure and leaving liquid temperature sensors are automatically detected and a fault warning message is displayed when a defective sensor is present.

SUMMARY OF THE INVENTION

The diagnostic system of the invention is incorporated in an air conditioning system having a liquid chiller wherein refrigerant flows through an evaporator to chill liquid circulating through a heat exchange coil in the evaporator, a pressure sensor sensing the pressure of the refrigerant in the evaporator while a temperature sensor senses the temperature of the chilled liquid leaving the evaporator. The diagnostic system, which detects when either one of the sensors is faulty, comprises means for developing, from the output of the pressure sensor, a refrigerant pressure signal representing the evaporator refrigerant pressure, and means for developing, from the output of the temperature sensor, a liquid temperature signal representing the leaving chilled liquid temperature. There are computing means for determining, from the refrigerant pressure signal and the liquid temperature signal, if the output of one of the sensors is in error, thereby indicating that the sensor is faulty. Warning means, controlled by the computing means, provides a warning message to operating personnel when a faulty sensor is detected.

In accordance with a more detailed aspect of the invention, the computing means calculates, from the refrigerant pressure signal, the equivalent evaporator refrigerant temperature based on the pressure-temperature relationship of the refrigerant. The equivalent temperature is subtracted from the leaving chilled liquid temperature to obtain a difference temperature which is then compared to a predetermined known temperature range (which extends, for example, from about −2.5° F. to about 25° F.) representing normal functioning of the sensors. If the sensors are operating correctly the difference temperature will always lie within that range regardless of the operating condition of the air conditioning system. On the other hand, when either one of the sensors is faulty the difference temperature will fall outside of the predetermined range. The warning means is actuated in response to determining that the difference temperature lies outside of the range.

DESCRIPTION OF THE DRAWINGS

The features of the invention which are believed to be novel are set forth with particularity in the appended claims. The invention may best be understood, however, by reference to the following description in conjunction with the accompanying drawings in which:

DESCRIPTION OF THE ILLUSTRATED EMBODIMENT

Figure 1:
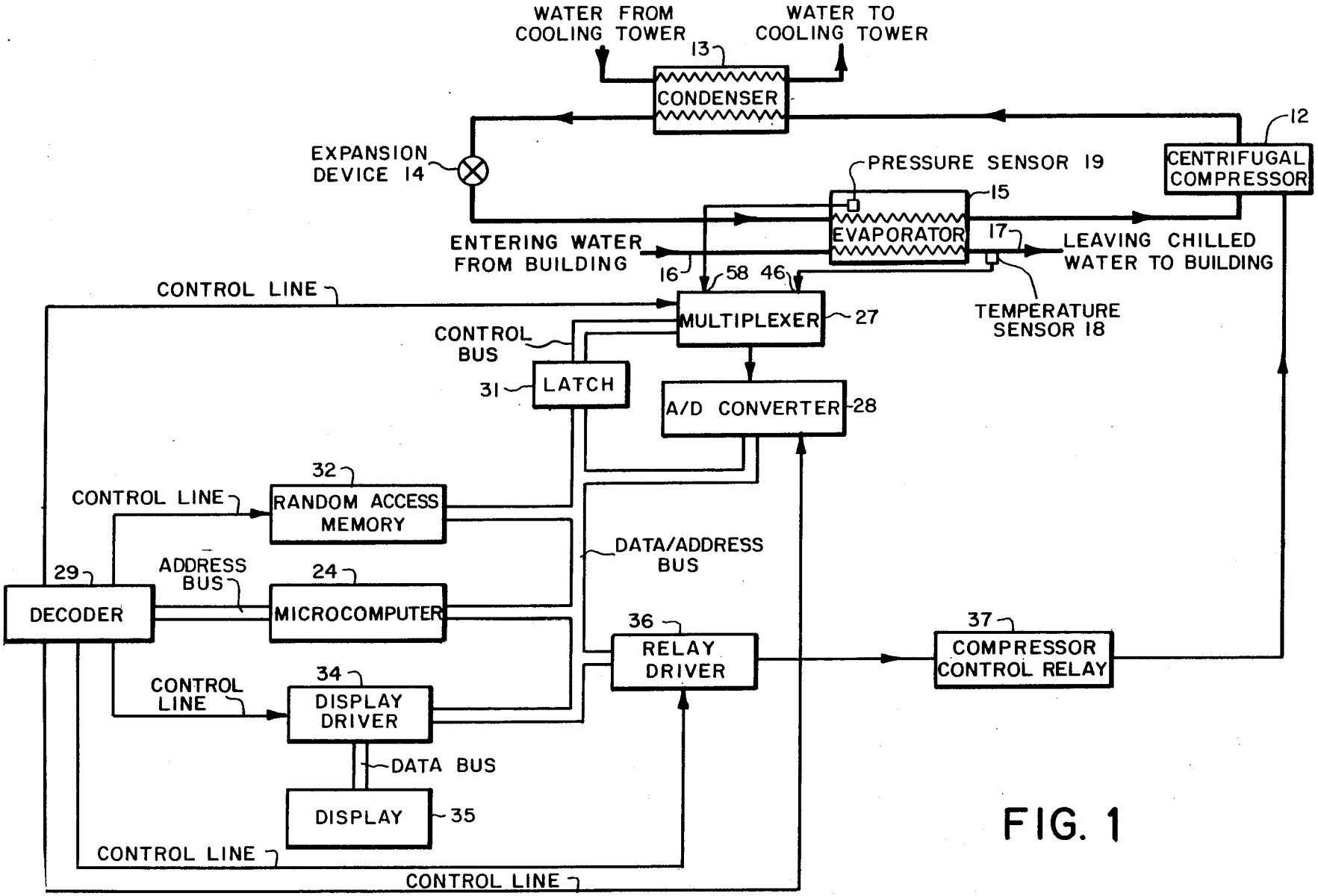
FIG. 1 is a block diagram illustrating a liquid chiller air conditioning system having a diagnostic system constructed in accordance with one embodiment of the invention; and, FIGS. 2*a*, 2*b* and 2*c* show a flow chart illustrating the logic sequence of operations and decisions which occur in operating the diagnostic system.

It will be assumed that the air conditioning system disclosed in FIG. 1 is a large commercial or industrial system of the type having a centrifugal liquid chiller. Centrifugal compressor 12 discharges compressed refrigerant which flows through condenser 13 where it condenses and cools by transfering heat to the water which circulates between the cooling tower (not shown) and the condenser. From the condenser 13 the refrigerant passes through the expansion device 14 and then through the evaporator 15 to the inlet of the centrifugal compressor. Liquid (specifically water in the illustrated embodiment) is received from the building (or other cooling load) over line 16 and flows through a heat exchange coil in the evaporator 15, after which it exits through line 17 for return to the building which may be remotely located from the evaporator. The liquid or water is chilled as it flows through the coil in evaporator 15, transferring heat to the refrigerant. After leaving the evaporator on line 17, the chilled water is employed to cool the building in any well-known manner. For example, air handlers or fan coil units may be used in which fans blow room air over coils through which the chilled water flows. The inlet of compressor 12 usually comprises adjustable guide vanes or prerotation vanes (PRV) to regulate the quantity of refrigerant flowing through the compressor. The capacity of the compressor is adjusted by varying the position of the prerotation vanes.

Temperature sensor 18, which may be a thermistor, is positioned to sense the temperature of the chilled water leaving the evaporator 15 and produces an electrical analog voltage signal which is proportional to and representative of the actual measured temperature. Customarily, control apparatus (not shown), which operates in response to the temperature sensed by sensor 18, controls the prerotation vanes to regulate the capacity of the compressor 12 as necessary to maintain the leaving chilled water temperature (LCWT) at a desired setpoint. The control system for the compressor has not been shown in order to avoid unduly encumbering the application.

In addition to the sensor for the leaving chilled water temperature, preferrably there are other sensors in the air conditioning system for monitoring and controlling different operating variables or parameters. Some of these variables may be sensed for safety reasons and appropriate steps may be taken when those variables fall outside of their desired limits. Pressure sensor 19, which is provided to monitor the refrigerant pressure in the evaporator 15 to prevent freeze-up of the circulating chilled liquid, outputs an analog voltage representing the evaporator refrigerant pressure. The circuitry which is conventionally connected to sensors 18 and 19 to utilize the sensed data has not been shown in FIG. 1 since such circuitry is not part of the invention. The outputs of sensors 18 and 19 have a predetermined known relationship relative to each other when the sensors are functioning properly, and this occurs regardless of the operating condition of the air conditioning system. There will always be a fixed relationship between the evaporator refrigerant pressure (which corresponds to a specific evaporator temperature) and the leaving chilled liquid temperature since it is the refrigerant which cools the liquid. By employing the known relationship, a comparison of the sensor outputs will reveal whether the sensors are faulty.

In short, microcomputer-based apparatus, which operates in response to the outputs of sensors 18 and 19, determines whether the predetermined known relationship, or an impossible relationship, exists between those outputs. Finding an impossible state means that at least one of sensors 18 and 19 is defective and an appropriate warning message is visually displayed to operating personnel to facilitate repair or replacement of the malfunctioning sensor. In addition, the air conditioning system is shut down as a safety precaution. This is implemented primarily by microcomputer 24 which may be of the type manufactured by Intel and designated by the number 8051. That particular microcomputer includes a ROM (read only memory) sufficient to permanently store the required program. All of the circuits controlled by microcomputer 24 are also of conventional construction and are commercially available. Multiplexer 27 is an integrated circuit chip and has the capability of simultaneously receiving analog voltage signals over several different input channels and outputting these signals one at a time to analog-to-digital (A/D) converter 28 under the control of decoder 29 and latch 31, which in turn are controlled by microcomputer 24. While multiplexer 27 is capable of handling a much larger number of inputs than the two needed to implement the invention, such a multiplexer would be needed to facilitate the monitoring and control of other parameters in the air conditioning system. RAM (random access memory) 32 is employed to store temperature information until it is needed. Display driver 34 when energized functions as a buffer and transmits data from the ROM in the microcomputer 24 to display 35 to provide a message to operating personnel. When relay driver 36 is operated the compressor control relay 37 is de-energized to disconnect the input power to the compressor motor, thereby shutting down the air conditioning system.

Although all of the necessary circuitry has not been illustrated in FIG. 1 to avoid unduly encumering the drawing, microcomputer 24 may easily be programmed to control and monitor different functions and operating characteristics of the air conditioning system. For example, the microcomputer may be programmed to control the compressor capacity, in response to the temperature sensed by sensor 18, to hold the leaving chilled water at a desired temperature setpoint. As the microcomputer is sequenced through its program, the information from sensor 18 representing the actual temperature of the leaving chilled water may be effectively compared with the desired setpoint information and from the comparison an appropriate control signal may be developed to adjust the prerotation vanes in centrifugal compressor 12 to the setting required to maintain the temperature of the leaving chilled water relatively constant and at the desired setpoint.

Figure 2A:
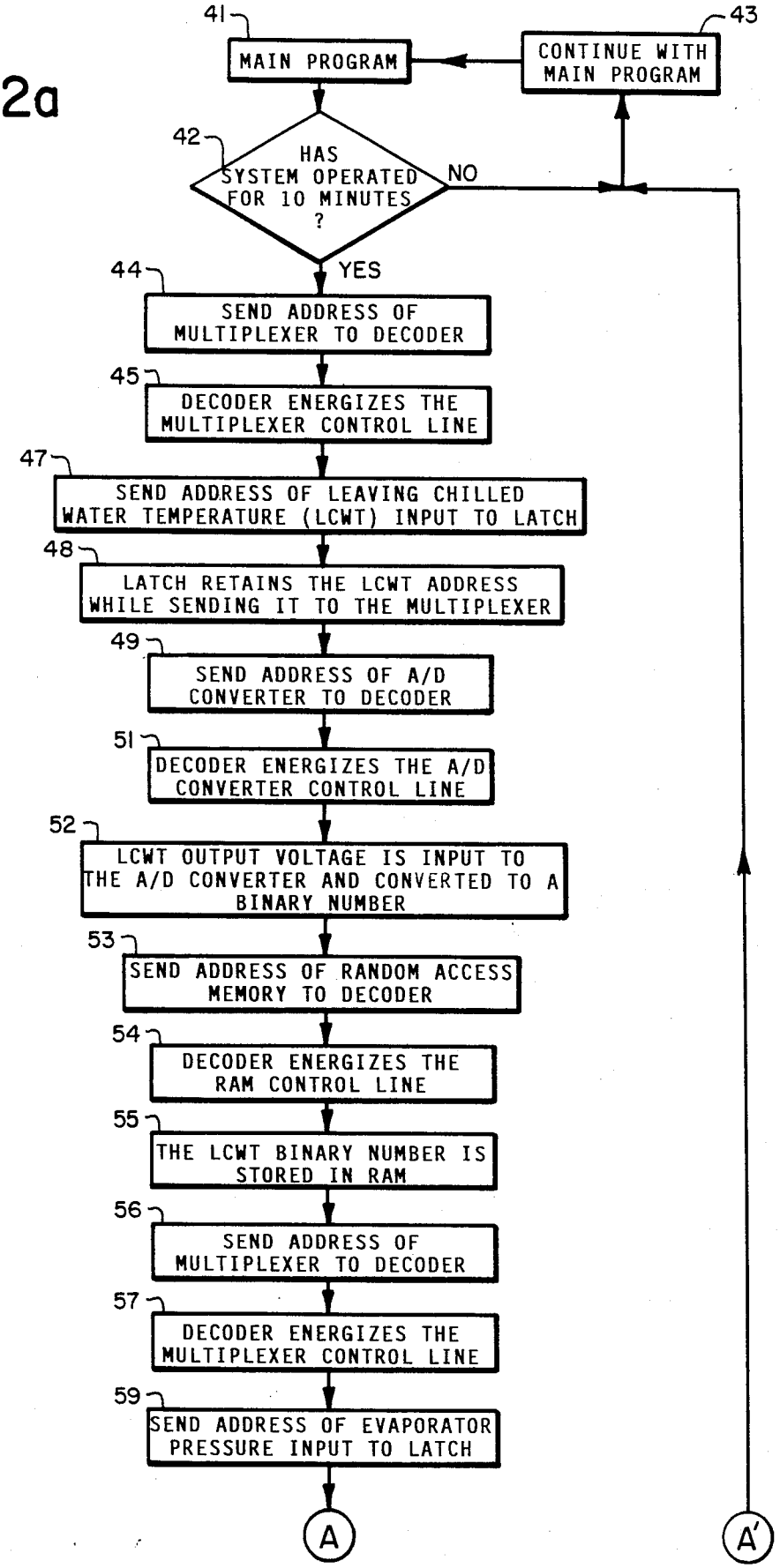
Figure 2B:
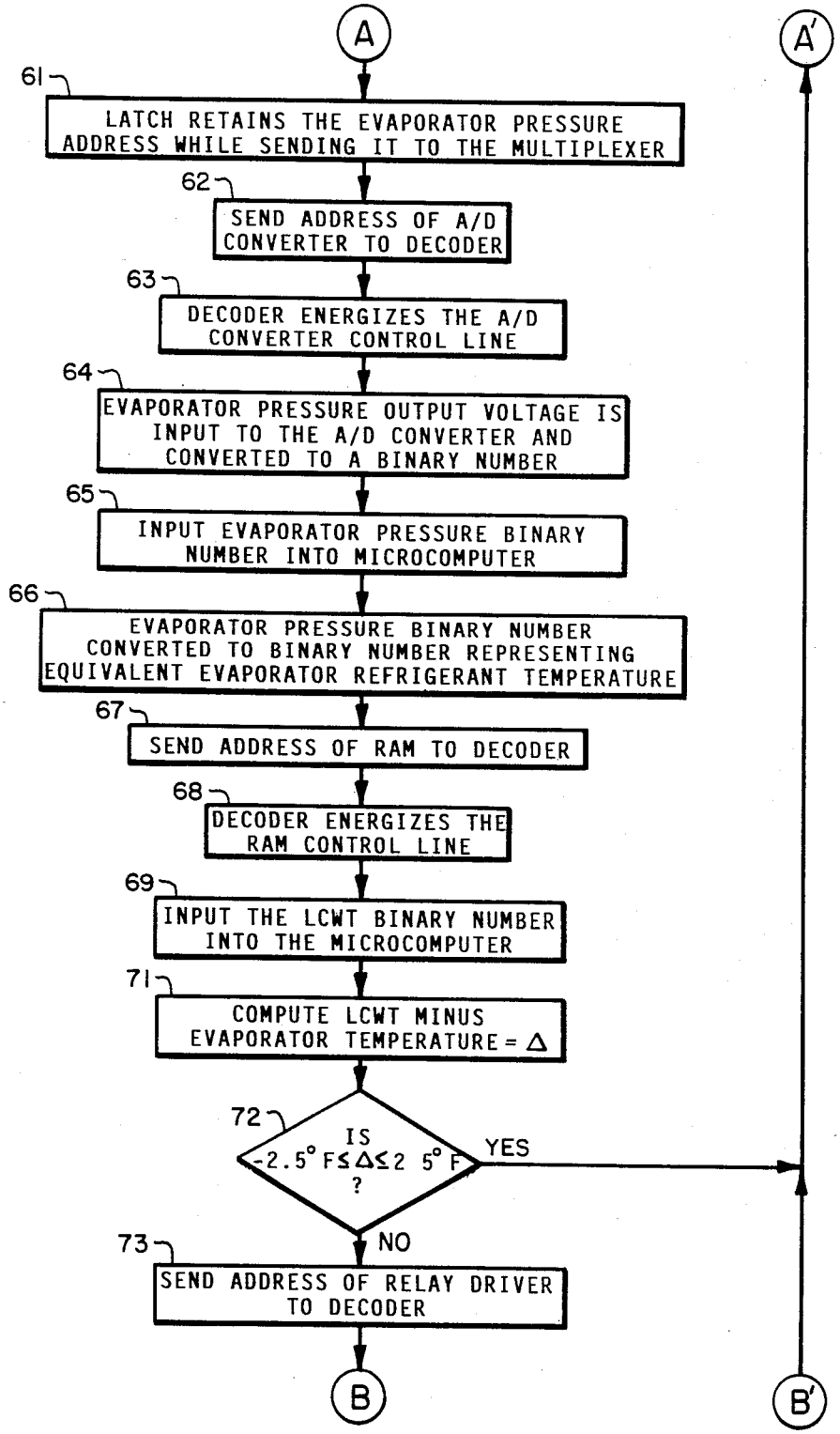
Figure 2C:
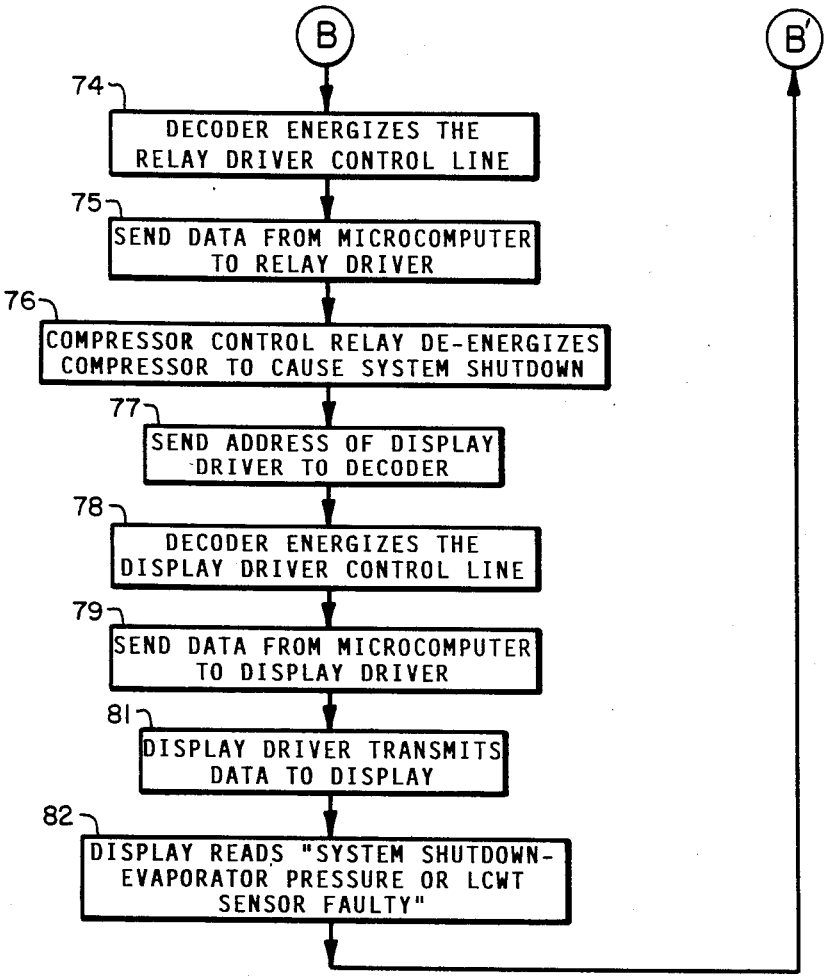

The operation of the invention may be more fully understood with the aid of the flow chart of FIGS. 2*a*, 2*b* and 2*c* which depicts the portion of the microcomputer's program dealing with the process for detecting if sensors 18 and 19 are faulty. Specifically, this program portion is a subroutine of the main program. Since the computing system is capable of monitoring and controlling several parameters in the air conditioning system, when all of the contemplated functions are included the complete program for microcomputer 24 will be substantially greater than that illustrated in FIGS. 2*a*, 2*b* and 2*c*. From the main program (block 41), decision block 42 determines whether the air conditioning system has been powered up and has been operating for at least ten minutes. This preset time period is necessary to allow the evaporator refrigerant pressure and the leaving chilled liquid temperature to stabilize. If the system has not been running for ten minutes the subroutine is bypassed and the main program is continued as indicated by block 43.

After ten minutes of system operation, microcomputer 24 transmits to decoder 29 (via the address bus) the address of multiplexer 27 (see operation block 44), whereupon the decoder energizes the control line to the multiplexer (block 45) to activate the multiplexer. The address of the leaving chilled water temperature (LCWT) input 46 to the multiplexer is then forwarded from microcomputer 24 and over the data/address bus to latch 31, as indicated by operation block 47, the latch retaining that address while at the same time transmitting it over the control bus to the multiplexer so that the analog voltage signal, appearing at input 46 and representing the leaving chilled water temperature, will be channeled to the output of the multiplexer, see block 48.

Hence, while the LCWT input address sent to latch 31 appears only momentarily, the address will be held by the latch so that the LCWT signal at input 46 will continue to be fed to the multiplexer output as long as the control line from the decoder remains energized.

Next, as shown by block 49, the address of the A/D converter 28 is forwarded to decoder 29 which then (block 51) supplies an energizing signal over the control line to converter 28. Since latch 31 will be holding the LCWT input address, the output voltage from sensor 18 will be fed through the multiplexer to the input of the A/D converter and converted to a digital signal or binary number (block 52) representing the leaving chilled water temperature. The program then steps to block 53, in accordance with which the address of RAM 32 is transmitted to decoder 29, which thereupon energizes the control line to the RAM (block 54) in order that the LCWT binary number may be stored (block 55) in the RAM for later use.

As indicated by block 56 in the flow chart, the address of the multiplexer is again sent to decoder 2 to effect energization by the decoder of the control line to the multiplexer (block 57). The address of the evaporator pressure input 58 is then transmitted from microcomputer 24 to latch 31 (block 59), which retains the address while sending it to the multiplexer (block 61). Next (block 62), the address of the A/D converter is forwarded to the decoder, in response to which the decoder energizes the control line to the converter (block 63) so that the evaporator pressure output voltage from sensor 19 will be input to the converter and converted to a digital signal or binary number (block 64) representing the evaporator pressure. The evaporator pressure binary number is then inputted to the microcomputer (block 65), after which the microcomputer (see block 66), using a pressure versus temperature look-up conversion table for the refrigerant (typically R11) which is stored in the ROM, converts the binary number representing the evaporator refrigerant pressure to a binary number representing the equivalent evaporator refrigerant temperature. Thereafter, the microcomputer feeds the address of the RAM to the decoder (block 67) to effect energization of the control line to the RAM (block 68) so that the LCWT binary number may be supplied to the microcomputer (block 69).

The step indicated by block 71 in the program is then executed by the microcomputer to subtract the equivalent evaporator refrigerant temperature from the leaving chilled water temperature. This is a binary subtraction of the two numbers representing the two temperatures and provides a resultant difference temperature Δ. During stabilized system operation and with properly functioning sensors 18 and 19, the difference temperature Δ will always fall somewhere within a known temperature range. In the illustrated embodiment that range extends from about −2.5° F. to about 25° F. Regardless of the operating condition of the air conditioning system, as long as the sensors are operating correctly the difference temperature Δ will lie between −2.5° F. and 25° F. This computation is determined by the microcomputer in accordance with decision block 72. The YES exit of block 72 will therefore be followed, when the sensors are functioning properly, and the subroutine will be terminated and the main program will be continued (block 43).

On the other hand, in the event that one of the sensors 18, 19 is malfunctioning or defective, the difference temperature Δ will fall outside of the temperature range and a NO answer will be determined by decision block 72 which effectively shows that an impossible relationship exists between the outputs of sensors 18 and 19 and thus between the leaving water temperature and the evaporator temperature, thereby indicating that the output of at least one of the sensors is in error and that the sensor is therefore faulty. Operation block 73 will thus be entered in accordance with which the address of the relay driver 36 is transmitted to the decoder from microcomputer 24 to generate an energizing signal on the control line to the relay driver (block 74). With the relay driver actuated, data will now be transmitted from the microcomputer to the relay driver (block 75) to effect de-energization of the compressor control relay 37 to shut the air conditioning system down (block 76). Thereafter (block 77), the address of the display driver 34 will be fed to the decoder to energize the control line to the display driver (block 78). Display data (stored in the ROM in the microcomputer) will now be sent to the display driver (block 79) via the data/address bus and then on to the display 35 over the data bus (block 81). As shown by block 82, the display data produces on display 35 the visible warning message "system shut down—evaporator pressure or LCWT sensor faulty". Upon viewing this warning information, operating personnel may easily identify and replace the particular sensor which is faulty. After the step is executed shown by operation block 82, the main program will be continued as indicated by block 43.

It will be appreciated that while the illustrated diagnostic system is microcomputer based, the invention could be implemented instead with other integrated circuits or even with discrete circuit components.

While a particular embodiment of the invention has been shown and described, modifications may be made, and it is intended in the appended claims to cover all such modifications as may fall within the true spirit and scope of the invention.

We claim:

1. In an air conditioning system having a liquid chiller wherein refrigerant flows through an evaporator to chill liquid circulating through a heat exchange coil in the evaporator, a pressure sensor sensing the pressure of the refrigerant in the evaporator while a temperature sensor senses the temperature of the chilled liquid leaving the evaporator, a diagnostic system for detecting when either one of the sensors is faulty, comprising:

means for developing, from the output of the pressure sensor, a refrigerant pressure signal representing the evaporator refrigerant pressure;

means for developing, from the output of the temperature sensor, a liquid temperature signal representing the leaving chilled liquid temperature;

computing means for determining, from the difference between the evaporator refrigerant temperature which is represented by said refrigerant pressure signal, and the leaving chilled liquid temperature which is represented by said liquid temperature signal, if the output of one or the sensors is in error, thereby indicating that the sensor is faulty;

and warning means, controlled by said computing means, for providing a warning message to operating personnel when a faulty sensor is detected.

2. A diagnostic system according to claim 1 wherein said computing means determines if a predetermined known relationship exists between the sensor outputs, a faulty sensor being indicated when the known relationship is not found.

3. A diagnostic system according to claim 1 wherein said warning means provides a visual display when a faulty sensor is discovered.

4. A diagnostic system according to claim 1 and including means, controlled by said computing means, for shutting the air conditioning system's compressor down as a safety precaution whenever a faulty sensor is found.

5. A diagnostic system according to claim 1 wherein said computing means includes a microcomputer.

6. A diagnostic system according to claim 1 wherein operation of said computing means is delayed for a preset time period following power up of the air conditioning system to allow the evaporator refrigerant pressure and the leaving chilled liquid temperature to stabilize.

7. A diagnostic system according to claim 1 wherein said computing means calculates, from said refrigerant pressure signal, the equivalent evaporator refrigerant temperature based on the pressure-temperature relationship of the refrigerant, and wherein the equivalent evaporator refrigerant temperature and the leaving chilled liquid temperature are effectively compared in determining whether one of the sensors is defective.

8. A diagnostic system according to claim 7 wherein the equivalent evaporator refrigerant temperature is subtracted from the leaving chilled liquid temperature to obtain a difference temperature which is then compared to a predetermined known temperature range representing normal functioning of the sensors, the difference temperature falling outside of the range when one of the sensors is faulty, and wherein said warning means is actuated in response to determining that the difference temperature lies outside of the range.

9. A diagnostic system according to claim 8 wherein the equivalent evaporator refrigerant temperature and the leaving chilled liquid temperature are represented by binary numbers and a binary subtraction of those numbers produces a resultant binary number which represents the difference temperature.

10. A diagnostic system according to claim 8 wherein the predetermined known temperature range extends from about −2.5° F. to about 25° F., the difference temperature falling within that range under any operating condition of the air conditioning system as long as the sensors are functioning properly.

* * * * *